United States Patent [19]

Hubbard

[11] Patent Number: 4,583,334

[45] Date of Patent: Apr. 22, 1986

[54] MODULAR CARRIER FOR STAIR TREAD

[76] Inventor: Robert M. Hubbard, 115 Rusty Gans Dr., Panama City Beach, Fla. 32407

[21] Appl. No.: 591,935

[22] Filed: Mar. 21, 1984

Related U.S. Application Data

[63] Continuation-in-part of Ser. No. 342,182, Jan. 25, 1982, abandoned.

[51] Int. Cl.[4] ..... E04F 11/12

[52] U.S. Cl. ..... 52/98; 52/105; 52/182; 52/741; 52/748

[58] Field of Search ..... 182/220, 228; 52/182, 52/184, 188, 191, 98, 105, 741, 748

[56] References Cited

U.S. PATENT DOCUMENTS

| | | | |
|---|---|---|---|
| 1,536,636 | 5/1925 | Tappen et al. | 82/228 |
| 3,608,256 | 9/1971 | Jefferys | 52/182 |
| 3,839,840 | 10/1974 | Miller | 52/741 |
| 3,888,058 | 6/1975 | Aherns | 52/191 |
| 3,978,628 | 9/1976 | Turner | 52/183 |
| 4,089,141 | 5/1975 | Heroux | 52/105 |

FOREIGN PATENT DOCUMENTS 1082462 9/1967 United Kingdom .

*Primary Examiner*—John E. Murtagh
*Attorney, Agent, or Firm*—Jones & Askew

[57] ABSTRACT

A modular carrier for stair treads (15) is provided so that treads may be evenly spaced and hung between a pair of stringers (25, 25'). A pair of vertical side walls (16, 16') extend above the tread and have a mounting plate connected thereto lying in a plane which intersects the plane of the tread at a predetermined angle ($\phi$). With the stringer set at this angle with respect to the horizontal, the treads lay in proper horizontal orientation. The plurality of notches or score lines are provided at the ends of the mounting plate (19, 20) which may be broken off, or overlapped, facilitating easy construction of evenly spaced stairs. Alternately, the left and right hand carriers are provided as separate units having a bottom plate 48 so that treads of varying widths may be used with the device.

7 Claims, 8 Drawing Figures

MODULAR CARRIER FOR STAIR TREAD

CROSS-REFERENCE TO RELATED APPLICATIONS

This application is a continuation-in-part of co-pending application Ser. No. 342,182, filed Jan. 25, 1982 entitled "Unitized Stair Tread With Adjustable Hangers", now abandoned.

TECHNICAL FIELD

The present invention relates to modular apparatus used in constructing stair treads, and more particularly discloses a prefabricated modular carrier for stair treads which is adapted to be used between pairs of unnotched stringers disposed at a predetermined angle between a first surface and a second surface.

BACKGROUND OF THE INVENTION

During the last decade, the cost of housing in the United States, and in some of the other industrialized countries of the world, has risen tremendously. In the United States in particular interest rates which were unheard of, and illegal, ten years ago are now commonplace. The 1970s saw interest rates in excess of 20% on mortgage money. This has led to a situation in which many middle class people have been unable to purchase single family dwellings.

Partly in response to this situation, lower cost methods of construction of housing have been developed. A number of prefabricated housing units are available in the market and have become quite popular in recent years due to the increase in quality of such units and their relatively low cost. Such units often include a number of standardized components which may be used in more than one particular house of the manufacturer, thus reducing the manufacturer's cost of inventory, and the need to employ skilled labor to fabricate custom components for a house.

As anyone who has ever attempted it knows, the construction of staircases in the conventional manner requires a fair degree of skill and precision measuring and cutting. In the conventional manner, a pair of parallel boards are disposed between a lower surface and an upper surface, normally first and second floors, to form a pair of stringers. When the location and length of the stringers are determined, perpendicular rectilinear cuts are made on the stringers at regular intervals. The horizontal portions of these cuts support the treads and the risers are attached to the vertical portions of the cuts during normal stair construction.

It is most desirable in constructing a staircase to make sure that stairs are regularly spaced and that the distance between the top stair and the second floor and the bottom stair and the first floor be commensurate with the distance between treads on the balance of the staircase. This is important for both aesthetic and safety reasons. Since people often walk down stairs at night, without the aid of light, or early in the morning when they are not fully awake, a discontinuity in the distance between adjacent treads, or a tread and a floor surface can give rise to an unpleasant surprise and often injury to the ankle or knee of a person who encounters such a discontinuity and is not prepared for it.

Many makers of prefabricated houses have adopted standard staircases as components of such housing and thus a large number of stringers wih the same cuts can be fabricated by the manufacturer and used in a variety of different units. However, the prior art has not provided an inexpensive and efficient apparatus which may be used to construct stairs between floors separated by a variety of distances which will still provide the desirable even spacing between adjacent treads, the top and bottom treads, and the floor surfaces.

Several prior art arrangements for providing prefabricated metal stairs have been made. For example, the method described in U.S. Pat. No. 3,839,840 shows an arrangement for constructing metal stairs where the stringers are provided with the flanges of a conventional "I-beam". A prefabricated cason for use in constructing metal staircases is also shown in British Pat. No. 1,082,462.

However, neither of these arrangements are satisfactory, or applicable to the more commonly encountered situation of constructing staircases in homes and other buildings in which wooden stringers are normally used.

SUMMARY OF THE PRESENT INVENTION

The present invention provides a modular carrier for stair treads which is particularly designed to overcome the above noted shortcomings in the prior art. In particular, the present invention provides a modular carrier designed to be used on an otherwise conventional stringer which may be cut and secured in place, without the need for notching the stringers for risers and treads.

Furthermore, the present invention provides a modular carrier for stair treads which allows the user to cut the ends of the stringers so that they fit between floor levels in a conventional fashion, and then simply put them in place in the same manner as they would be placed had the conventional notches been cut. Thus, conventional methods of measuring, cutting and securing stringers can be used without the requirement that the time consuming step of providing rectilinear cuts for treads and risers be made.

The present invention provides such an apparatus by having a surface for supporting a stair tread, which can include an integral stair tread thereon, and having a pair of spaced apart vertical side walls extending above the tread surface. The side walls include a top edge which is tilted with respect to the plane of the tread at a predetermined angle. The predetermined angle is equal to the angle at which the stringers are placed with respect to the horizontal, assuming that the treads are to be horizontal, in the resultant staircase.

Attached to the top edge of each of side walls is a mounting plate which is adapted to be laid over the upper surface of the stringers. Thus, the present invention provides an arrangement wherby, once the stringers are set at a predetermined angle, the integral, tread, side wall, and mounting plate may simply be laid over the stringers and secured thereto.

The present invention further provides a plurality of notches and/or score lines for fitting adjacent modular carriers together so that the resultant staircase includes the proper number of stair treads, spaced properly with respect to each other.

In the method of the present invention the user need only determine the height between the two levels to be connected by the staircase and the number of steps desired on the case. From this, the distance along the mounting surface for each modular carrier is unambiguously determined. In constructing the staircase, the user need only overlap portions of the mounting surface of the next adjacent lower carrier over the lower end of the mounting surface of each carrier at a predetermined position determined by the above-referenced calculation. In the preferred form of the present invention, indicia corresponding to the results of the above-noted calculation are provided so that the staircase may be quickly assembled without error.

In another form of the present invention, an extended portion of each mounting surface is provided and score lines are provided on the extended portion. The extended portion is made of a frangible material, such as relatively thin fiberglass, so that parts of the extended portions of the mounting surfaces may be broken off at the appropriate places and the stairs may be constructed by simply abutting the remaining portions of the mounting plates. Alternately, the carriers according to the present invention may be constructed of metal, and the appropriate part of each extended portion may be cut off prior to assembly of the staircase.

Thus, by providing a plurality of embodiments of the present invention with several respective predetermined angles between the horizontal tread and the slope of the mounting surfaces, a wide variety of staircases, suitable for virtually any application, may be constructed.

Thus, it is an object of the present invention to provide a modular carrier for a stair tread which is readily adapted to be used in connection with conventional wooden stringers which do not have to be cut along their lengths extending between two floor levels.

It is a further object of the present invention to provide a modular stair carrier designed to be used on stringers set at a predetermined angle with respect to the horizontal for which the number of stairs in a given staircase may be varied according to the desired spatial relationship between adjacent treads.

It is a further object of the present invention to provide an improved method of stair step construction using modular carriers for the stair treads which is quick, efficient, and can be dependably implemented by relatively unskilled labor.

It is a further object of the present invention to provide prefabricated modular carriers for stairs which may be made from a variety of materials including stamped metal and molded fiberglass.

That the present invention accomplishes these objects, and overcomes the above-noted drawbacks of the present invention will become apparent from the detailed description below.

DETAILED DESCRIPTION

Figure 1:
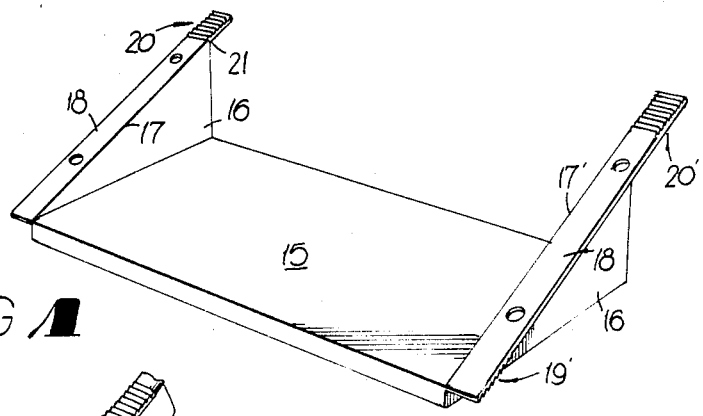
FIG. 1 is a pictorial view of a first preferred embodiment of the present invention.

Turning first to FIG. 1, a pictorial view of the first preferred embodiment of the present invention is shown. The first preferred embodiment is one for which a pair of side walls and a tread of predetermined width are integrally formed. As may be seen in FIG. 1, a bottom tread, or tread, 15 is provided. Extending vertically from each end of the bottom tread is a pair of side walls, 16 and 16'. Each of side walls 16 and 16' includes a top edge shown, respectively, as 17 and 17'.

As may be seen in FIG. 1, the top edge 17 forms a predetermined angle, shown as $\phi$ with respect to the plane of bottom tread 15. Connected to each of the top edges 17 is a mounting plate 18. Mounting plate 18 intersects side walls 16 at a right angle and lies in a plane which is parallel to top edge 17 and tilted at the predetermined angle $\phi$ with respect to the plane of the upper surface of bottom tread 15.

Each of mounting surfaces 18 includes a lower scored or notched surface 19 and an upper scored or notched surface 20 extending above a respective upper end point 21 of top edge 17.

As is explained hereinbelow, portions 19 and 20 are notched in the preferred form so that the upper surface of portion 20 will engage the lower surface of portion 19 when lapped thereover during use of the preferred embodiment. Alternately, scoring or notching of lower surface 19 is omitted and extended portion 20 on mounting plate 18 is scored so that predetermined increments of the extended portion of the mounting surface may be broken off or cut off during use.

Figure 2:
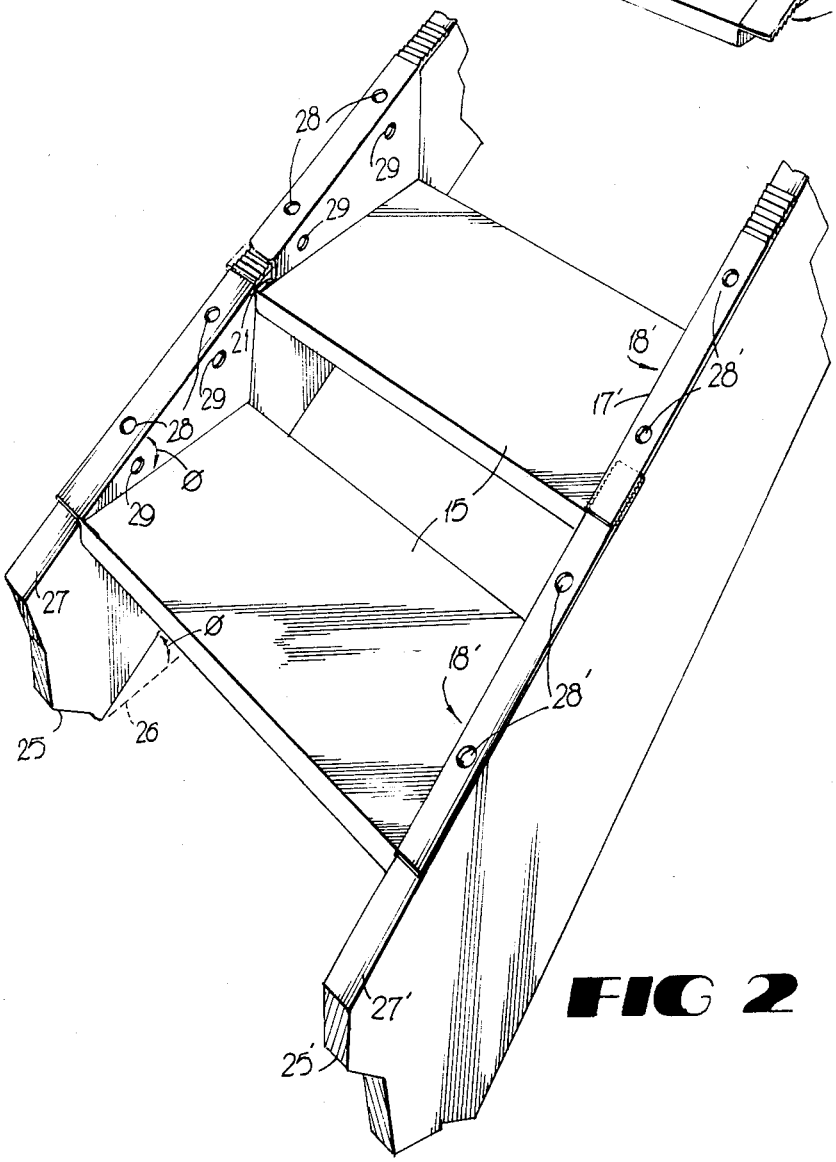
FIG. 2 is a pictorial view of a plurality of the preferred embodiment of FIG. 1 set on a pair of stringers.

Turning next to FIG. 2, an example of two of the embodiments of FIG. 1 as used in a portion of an assembled staircase are shown. In FIG. 2, the modular carriers for the present invention are disposed between a pair of stringers 25 and 25'. Dashed line 26 shows a horizontal line parallel to the horizontal upper surface of bottom tread 15.

As may be seen in FIG. 2, stringers 25 and 25' are disposed at the same predetermined angle $\phi$ with respect to the horizontal as top edge 17 forms with bottom tread 15. Mounting plates 18 are laid over the upper support surfaces 27 and 27' of stringers 25 and 25'. Note that in the present example the predetermined angle $\phi$ is shown with respect to the bottom edge of stringer 25. This assumes the common convention of having upper support surface 27 of stringer 25 parallel to the bottom surface. However, it will be readily apparent that the important factor is that the upper support surface 27 form the predetermined angle $\phi$ with the horizontal, irrespective of the geometry of the lower surface of the stringers.

Also shown on FIG. 2 are a plurality of holes 28 and 28' in mounting plates 18 and 18'. Likewise, a plurality of holes 29 are shown in side walls 16 These are provided so that screws, nails or the like may be used to secure side walls 16 and mounting plates 18 to stringers 25.

Turning for a moment to the intersection between the two carriers shown atop stringer 25, one aspect of the preferred method of using embodiments of the present invention will be described. Upper end point 21 of top edge 17 is visible in FIG. 2. Thus, a part of extended portion 20 is uncovered, as shown in the drawing figure. In this arrangement, notches appearing on the top side of extended portion 20 of mounting surface 18 are covered and engaged by corresponding notches (not shown) on the lower surface of mounting plate 18 for the immediately adjacent carrier above extended portion 20. It is within the scope of the present invention that upper and lower surfaces overlap in either sense (upper over lower or lower over upper), but FIG. 2 shows the preferred arrangement so that remaining free ends of extending portions 20 of the carriers will not be exposed.

Figure 3:
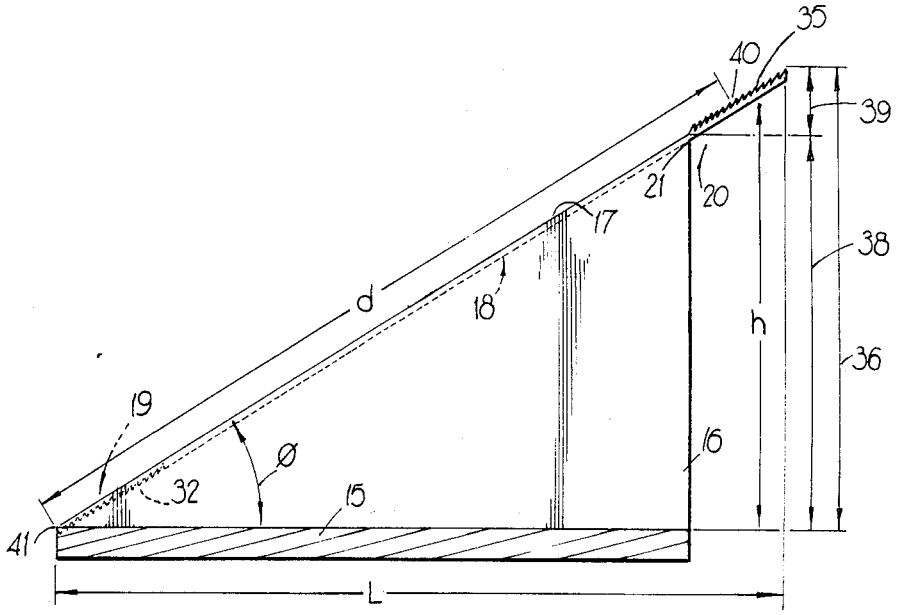
FIG. 3 is an end elevational view of the preferred embodiment of FIG. 1 showing the geometric relationship between the parts.

Turning next to FIG. 3, a side elevational view is shown to demonstrate the geometry of the present invention. As in the previously described drawing figures, top edge 17 forms a predetermined angle $\phi$ with respect to bottom tread 15. Notch means 32 appear on the lower surface of mounting plate 18 and corresponding notch means 35 appear on the upper surface of extended portion 20 of mounting plate 18.

The exemplary preferred embodiment shown in FIG. 3 is one in which length dimension L is 12 inches. The total height between the surface of tread 15 and the extreme end of extended portion 20 is shown by dimension line 36 and is preferably 7½ inches. The vertical projection of extended portion 20 is indicated by dimension line 37 which is 1 inch in the preferred embodiment. Thus, the vertical height between tread 15 and upper end point 21, shown by dimension line 38, is equal to 6½ inches. From this, simple trigonometry indicates that predetermined angle $\phi$ in the preferred embodiment is 32° since it is readily determined as the arctangent of seven and one-half inches divided by 12 inches.

From this, it is apparent that the length of extended portion 20 is approximately 1.89 inches (1/SIN 32°). Thus, if the notches of notch means 32 and 35 are equally spaced at ⅛ inch intervals, fifteen ⅛ inch notch intervals are provided in the preferred embodiment.

The preferred forms of the method of the present invention are executed as follows. It is first assumed that either the stringers will be disposed at predetermined angle $\phi$, determined by a single available embodiment of the present invention, or that two or more embodiments of the present invention are available to the user characterized by two distinct angles $\phi$. The user selects the appropriate angle $\phi$, and set the stringers accordingly.

The total vertical distance between the two floors to be connected is designated as H. Next, the user selects a number n to represent the number of steps desired between the two floors. H/n is defined as h, the height between adjacent treads. An arbitrary example is shown as h in FIG. 3.

Alternately, the distance h between adjacent treads may be most important to the user and a first approximation of this number can be selected first. This number can then be divided into H to determine a first approximation for the number n. n must then be rounded to an appropriate integer value to provide evenly spaced stairs. It will be readily apparent that for any given embodiment of the present invention, and any given distance H between two adjacent stories, the possible range of values for n may be determined by taking the integer part of H divided by the minimum value for h (the length of dimension line 38) and dividing H by the maximum value for h ( the length of dimension line 36).

However it is arrived at, the value of h determines the value of distance d along mounting plate 18 as shown in FIG. 3. Thus, first step of the method may be considered calculating distance d.

As shown in the example of FIG. 3, d extends between the lower end of mounting plate 18 and a point indicated at 40 on extended portion 20. In the preferred form, indicia are provided next to notches 35 on extended portion 20 which are calibrated in values of h. Thus, in placing the modular carriers on the stringers, adjacent carriers need to be disposed so that lower end point 41 of mounting plate 18 engages point 40 in the next contiguous carrier below and the stairs will be properly and evenly spaced.

In an alternate method, referred to above, extended portion 20 is made of frangible material and provided with score lines corresponding to notch means 32 and thus part of extended portion 20 extending above point 40 may be broken off. In using this method, point 40 is merely butted against point 41 for adjacent carriers. Alternately, the carrier of the present invention may be constructed from metal and extended portion 20 may simply be cut off at point 40.

It should further be apparent to those skilled in the art that (n−2) carriers according to the present invention will be needed in the above recited example since the significance of the number n is the number of equally spaced increments of height h between the floors. Naturally, one of these increments will be met by the space h between the topmost tread of the staircase and the second floor itself, and another will be met by the space between the bottommost tread and the first floor surface. Thus, it should be understood that the reference to n means that n−2 carriers will actually need to be provided.

Figure 4A:
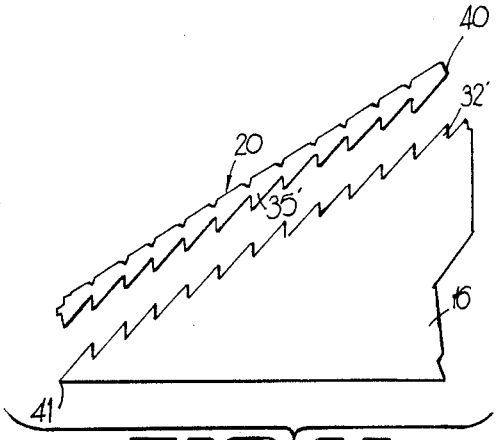
FIG. 4, consisting of FIGS. 4A and 4B, shows alternate arrangements for joining adjacent modular carriers according to the present invention.
Figure 4B:
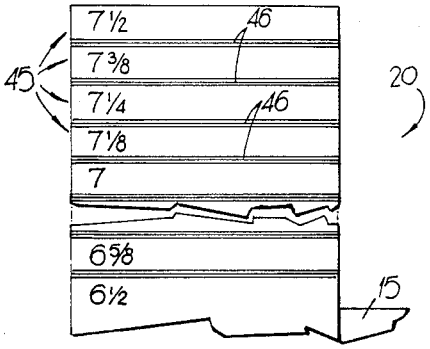

Turning next to FIGS. 4A and 4B, an alternate arrangement for notch means 32 and 35 are shown as 32' and 35'. In this arrangement, the notches on extended portion 20 are downward facing and are thus shown as 35' to suggest that they correspond to notch means 35 shown on FIG. 3 but are distinct therefrom. Similarly, notch means 32 near lower end point 41 are shown as 32'.

FIG. 4B shows an example of the indicia 45 and score lines 46 on extended portion 20. The example shown on FIG. 4 corresponds to the above description in which indicia 45 are denominated in values for h. It will be appreciated from viewing the indicia shown on FIG. 4B that the values for h extend between the 6½ inches and 7½ inches described hereinabove in increments of ⅛ inch. Of course, other increments may be used and it is also possible to use indicia calibrated in terms of distance d, where desired From the foregoing, it will be readily appreciated that while the preferred form of the invention is to have extended portion 20 be present above upper end point 21 of top edge 17, that fully equivalent embodiments of the present invention may be constructed wherein the extended portion lies below point 41 and thus, the particular end from which the extended portion is provided is not considered cirtical. Likewise, structures corresponding to the extended portions 20 may be provided separately and used as spacers.

Figure 5:
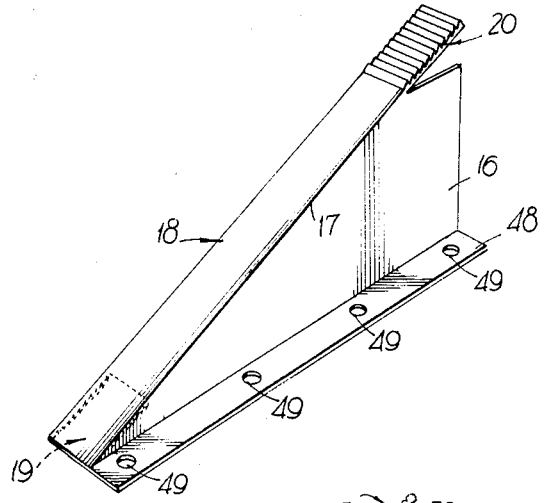
FIG. 5 is a pictorial view of an alternate embodiment of the present invention.

FIG. 5 shows an alternative arrangement for the present invention in which like parts of the first preferred embodiment are numbered with like reference numerals. The embodiment of FIG. 5 differs from the embodiment of FIG. 1 in that a bottom plate 48 is provided for carrying a tread but no tread is integrally formed with this embodiment. A plurality of holes 49 are provided as means for attaching a tread to the bottom plate which, naturally, will be used in connection with screws, nails, or the like. The embodiment of FIG. 5 is one which allows use of the present invention with stairs characterized by treads of variable width. From the foregoing, it will be readily apparent that a mirror image of the embodiment of FIG. 5 must be used in connection with the embodiment shown and that these two are used in pairs to construct a staircase according to the present invention.

Figure 6A:
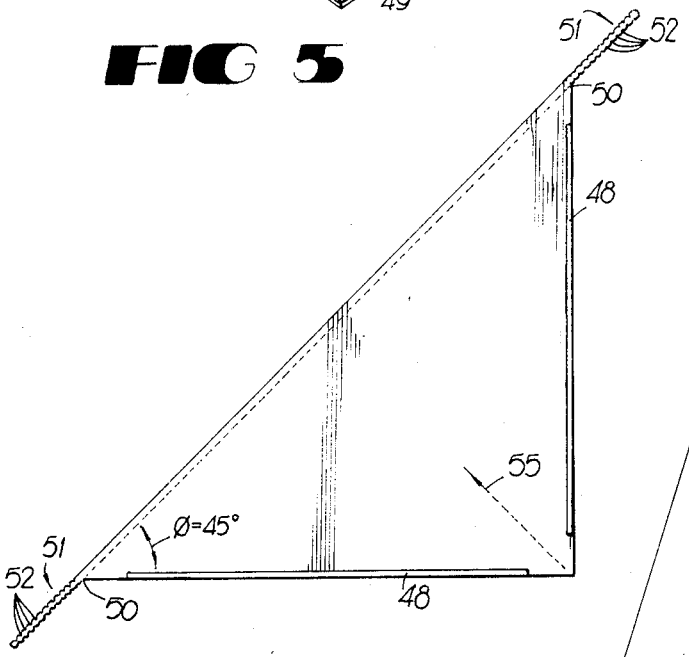
FIG. 6A is a side elevational view of a third embodiment of the present invention and FIG. 6B is a pictorial view of the embodiment of FIG. 6A.
Figure 6B:
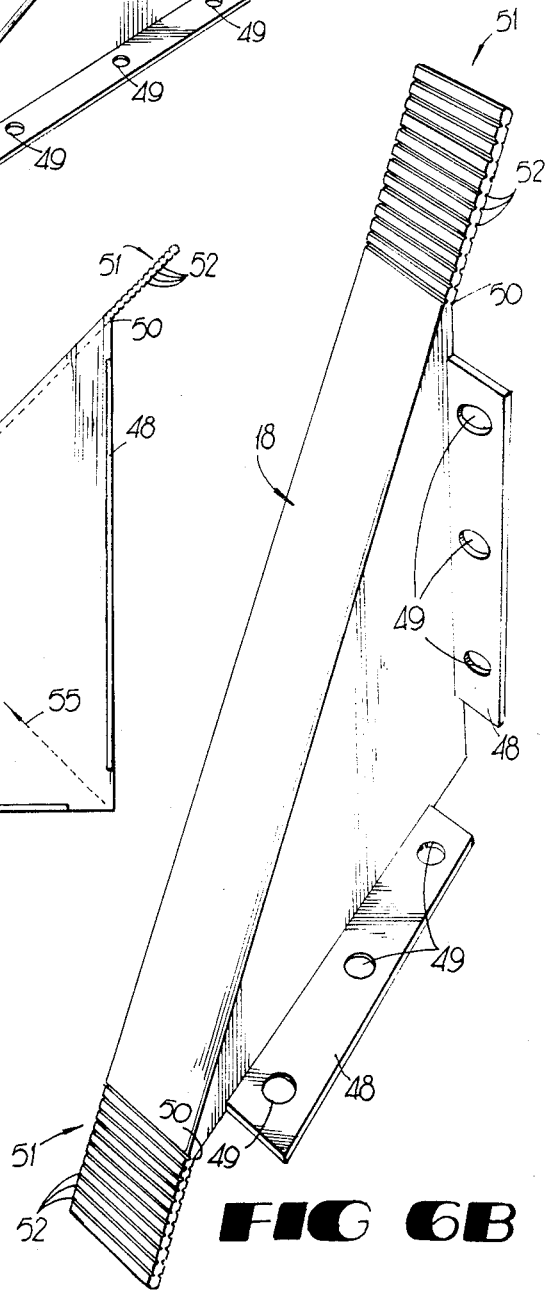

FIGS. 6A and 6B shown an alternate embodiment of the present for which only a single specific embodiment of the present invention must be provided for the construction of a staircase. This particular embodiment is limited to use in construction of staircases with stringers extending at 45° to the horizontal.

As is shown in FIG. 6A, predetermined angle $\phi$ equals 45°. From inspection of FIG. 6, it will be apparent that the embodiment shown therein is bilaterally symmetrical with respect to a line shown as 55 bisecting the right angle at the corner of vertical side wall 16. Thus, the 45° angle shown at the upper corner of the embodiment of FIG. 6A is also designated as $\phi$, and is equal to 45°. Similarly, two extended portions 51 are provided between end points 50 in this embodiment. In the preferred form of the embodiment of FIG. 6A, score lines 52 are provided at each of extended portions 51 and extended portions 51 are constructed of frangible material so that it may be readily broken or cut along the score lines. As may be seen in FIG. 6, a pair of bottom plates 48 are provided on each edge of vertical side wall 16.

Due to the symmetry of the embodiment of FIG. 6, it will be readily understood that mounting plate 18 may be laid over either the right or left hand stringer (with the stringers set at 45°) and one or the other of bottom plates 48 will be horizontal, ready to support a stair tread. In using this embodiment, it is preferable to break off the entirety of an apropriate one of extended portions 51 to correspond to the lower end point of mounting plate 18 shown in the previously described embodiment, and to break off an appropriate portion of the other of extended portions 51 to set the carriers for appropriate tread-to-tread spacing.

From the foregoing description, it will be apparent that the present invention accomplishes the objects set forth above and overcomes the cited drawbacks of the prior art. In view of the foregoing description of several embodiments of the invention, other embodiments will suggest themselves to those skilled in the art and the scope of the present invention is to be limited only by the claims below.

I claim:

1. A modular carrier for suspending a stair tread from a pair of stringers comprising in combination:

a bottom tread;

a pair of side walls extending vertically from each end of said bottom tread including a top edge forming a predetermined angle with said bottom tread;

each of said top edges having a mounting plate attached thereto, said mounting plate lying in a plane which is parallel to said top edge and tilted at said predetermined angle with respect to said bottom tread;

each of said mounting plates including an extended portion extending beyond an upper end point of said top edge, and each of said mounting plates including notched joining means at each end thereof for attaching each respective end of said mounting plate at one of a plurality of selectable discrete positions along said mounting plate to a like mounting plate on an adjacent like modular carrier.

2. A modular carrier as recited in claim 1 wherein each of said notched joining means on each of said extending portions includes a plurality of equally spaced indicia.

3. A modular carrier as recited in claim 1 wherein said side walls and each of said mounting plates are integrally constructed of fiberglass.

4. A method of constructing a staircase between a first surface and a second surface comprising the steps of:

providing a plurality of modular carriers, each modular carrier comprising;

a bottom tread, a pair of side walls extending vertically from each end of said bottom tread including a top edge forming a predetermined angle with said bottom tread, each of said top edges having a mounting plate attached thereto, said mounting plate lying in a plane which is parallel to said top edge and tilted at said predetermined angle with respect to said bottom tread;

securing a pair of stringers between said first surface and said second surface so that an upper support surface of each of said stringers forms substantially said predetermined angle with a horizontal plane;

selecting a number N of said modular carriers to be placed on said stringers between said first surface and said second surface;

calculating a distance d along said mounting plate such that $N \times d$ equals a characteristic length of said upper support edge of said stringers;

removing a portion at each of said extended portions of said mounting plates from each of said modular carriers so that each said mounting plate is distance d in length;

placing said plurality of modular carriers on said stringer so that said mounting plates engage said upper support surface of said stringers and said mounting plates abut against each other for the entire length of said upper support surfaces; and securing said modular carriers to said stringers.

5. A modular carrier for suspending a stair tread from a stringer comprising:

a bottom plate for supporting said tread;

a side wall extending vertically above said bottom plate;

said side wall including a top edge forming a predetermined angle with said bottom plate;

said top edge having a mounting plate attached thereto, said mounting plate lying in a plane which is parallel to said top edge and tilted at said predetermined angle with respect to said bottom plate, said mounting plate including notched joining means at each end thereof for attaching each respective end of said mounting plate at one of a plurality of selectable discrete positions along said mounting plate to a like mounting plate on an adjacent like modular carrier.

6. A modular carrier for suspending a stair tread from a pair of stringers comprising in combination:

a bottom tread;

a pair of side walls extending vertically from each end of said bottom tread including a top edge forming a predetermined angle with said bottom tread;

each of said top edges having a mounting plate attached thereto, said mounting plate lying in a plane which is parallel to said top edge and tilted at said predetermined angle with respect to said bottom tread;

each of said mounting plates including an extended portion extending beyond an upper end point of said top edge;

each of said extended portions including a plurality of equally spaced indicia;

wherein each of said extended portions is made of a frangible material and each of said indicia includes a corresponding score line across said extended portion.

7. A modular carrier for suspending a stair tread from a pair of stringers comprising in combination:

a bottom tread;

a pair of side walls extending vertically from each end of said bottom tread including a top edge forming a predetermined angle with said bottom tread;

each of said top edges having a mounting plate attached thereto, said mounting plate lying in a plane which is parallel to said top edge and tilted at said predetermined angle with respect to said bottom tread;

each of said mounting plates including an extended portion extending beyond an upper end point of said top edge;

wherein each of said extended portions is made of a frangible material and includes a plurality of score lines across said extended portion.

* * * * *